US008944431B1

(12) United States Patent
Piatt et al.

(10) Patent No.: US 8,944,431 B1
(45) Date of Patent: Feb. 3, 2015

(54) COMPACT INVERTER FOR CUT SHEET MEDIA

(71) Applicants: Michael Joseph Piatt, Dayton, OH (US); Harsha S. Bulathsinghalage, Miamisburg, OH (US)

(72) Inventors: Michael Joseph Piatt, Dayton, OH (US); Harsha S. Bulathsinghalage, Miamisburg, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/947,164

(22) Filed: Jul. 22, 2013

(51) Int. Cl.
*B65H 15/00* (2006.01)

(52) U.S. Cl.
USPC ..... 271/225; 271/186

(58) Field of Classification Search
CPC ..... B65H 15/00; B65H 2301/333; B65H 2301/3421; B65H 2301/33212
USPC ..... 271/225, 186
See application file for complete search history.

(56) References Cited

U.S. PATENT DOCUMENTS 4,019,435 A * 4/1977 Davis ..... 101/232
4,027,870 A 6/1977 Frech et al.
4,903,043 A 2/1990 Tajima
4,988,088 A 1/1991 Aiba
5,042,791 A * 8/1991 Stemmle ..... 271/186
5,052,678 A * 10/1991 Looney ..... 271/186
5,441,252 A 8/1995 Hommes
5,538,240 A 7/1996 Auerbach et al.
6,227,532 B1 5/2001 Bakoledis
6,554,276 B2 * 4/2003 Jackson et al. ..... 271/301
8,109,510 B2 * 2/2012 Sugiyama et al. ..... 271/276
2002/0096822 A1 * 7/2002 Glemser et al. ..... 271/186
2002/0141805 A1 * 10/2002 Bobrow et al. ..... 400/188
2010/0278575 A1 * 11/2010 Mizuno et al. ..... 399/401
2012/0248680 A1 * 10/2012 Takaishi et al. ..... 271/109
2012/0251212 A1 * 10/2012 Hasegawa et al. ..... 399/381
2013/0214479 A1 * 8/2013 Dobrindt ..... 271/225
2013/0320615 A1 * 12/2013 Nakamura et al. ..... 271/225

* cited by examiner

*Primary Examiner* — Patrick Cicchino
(74) *Attorney, Agent, or Firm* — Kevin E. Spaulding

(57) ABSTRACT

A media inverting system is described for a cut sheet printing system. A first media transport advances a media sheet in a first direction, the media sheet having a first side that contacts the first media transport and an opposing second side. A rotatable member having a rotation axis that is substantially parallel to the first direction receives the media sheet from the first media transport and rotates to advance the media sheet around the rotatable member. A rotatable member force mechanism is switchable between a first state where the second side of the media sheet is held to the rotatable member, and a second state where the media sheet is released. A second media transport receives the media sheet from the rotatable member and advances the media sheet in an inverted orientation in a second direction that is substantially parallel to the first direction.

21 Claims, 14 Drawing Sheets

COMPACT INVERTER FOR CUT SHEET MEDIA

FIELD OF THE INVENTION

This invention pertains to the field of media handling for cut-sheet printing systems, and more particularly to an apparatus inverting the media sheets for printing on a second side.

BACKGROUND OF THE INVENTION

In a digitally controlled printing system, a receiver media (also called a print media) is directed through a series of components for printing an image. The receiver media can be a continuous web of media or a sequential flow of cut sheets of media. In the case of a cut-sheet printing system, a media transport system physically moves the receiver media sheets through the printing system. As the receiver media sheets move through the printing system, a printing process is carried out on a first side of the receiver media sheets. For example, in an inkjet printing system, liquid (e.g., ink) is applied to the receiver media sheet by one or more printheads through a process commonly referred to as jetting of the liquid.

In many printing applications it is desirable to print on both sides of the receiver media sheets, thereby saving cost and being more environmentally friendly. Some printing systems are capable only of printing on a single side of the receiver media sheets. In this case, a user who wishes to print on both sides of the receiver media sheets can print the odd numbered pages, reload the stack of print media sheets, and then print the even numbered pages. However, this is slow and cumbersome. A more user-friendly printing system is one that includes a media inverter, also called a duplexer, for duplex printing.

Desktop printing systems typically use a carriage to move a printhead across the receiver media sheet to print a swath of an image and advance the receiver media sheet between swaths in order to form the image swath-by-swath. Such printing systems are small and low-cost, but printing throughput on single sides of letter-sized receiver media sheets is typically limited to around 20-30 pages per minute. Because the distance the receiver media sheet is moved through a desktop printing system is small, the transport system can be a series of rollers. Printing of all of the colors of the image is performed in a relatively small print zone compared to the length of the receiver media sheet. For printing a single side, the receiver media sheet is advanced swath-by-swath sequentially past the print zone. For duplex printing, the receiver media sheet is typically driven through a duplexer by one or more rollers to turn the receiver media sheet over and return the receiver media sheet to a point prior to the print zone so that the second side can be printed.

High-volume cut-sheet printing systems typically print one color of an entire line of the image essentially all at once, for example using a page-width printhead or some other page-width printing process in a printing station for that color. The receiver media sheet is advanced past the printing station as sequential page-width lines of the same color are printed. To print all colors (typically cyan, magenta, yellow and black), the receiver media sheet is moved from printing station to printing station, each printing station printing a different color. In a high volume inkjet printing system, there are typically dryers between some or all of the printing stations in order to remove some of the carrier fluid of the ink and make the ink less mobile so that it is less susceptible to bleeding into the next color that is printed.

In web printing systems, tension in the continuous web of receiver media can be used to pull the web through the various printing stations. In high-volume cut-sheet printing systems, a media transport system, which typically includes components such as belts or drums, is used to move the receiver media sheets through the printing system from one printing station to the next. High-volume cut-sheet printing systems tend to be significantly larger and more costly than desktop printing systems. However, the printing throughput is also typically significantly higher.

Because of the successive printing stations, and other stations such as dryers or fusers, in a high-volume cut-sheet printing system, the distance between the input to the first printing station and the output of the last printing station can be relatively large compared to the length of the receiver media sheet. A simple roller-driven duplexer that can position the lead edge of the receiver media sheet close enough to the print zone that a feed roller can begin to pull the leading edge before trailing edge of the receiver media sheet passes the duplexer drive roller is not adequate in such a large high-volume cut-sheet printing system. Furthermore, some high-volume cut-sheet printing systems include a first printing module including all of the color printing stations for printing a first side of the sheets, and a second printing module including all of the color printing stations for printing a second side of the sheets. A media inverter is positioned between first printing module and the second printing module.

Although high-volume cut-sheet printing systems can be inherently large, it is desirable that they not be excessively large. In addition, since high volume cut-sheet printers have capability for high printing throughput, other components of a printing system should be able to keep up with the printing throughput so that they do not compromise the overall throughput of the system. Therefore, there is an ongoing need for a media inverter that is compact and high speed in turning the cut receiver media sheets over and providing the cut receiver media sheets in a proper orientation to the beginning of the printing process for the second side, either using the same printing module or in a different printing module.

SUMMARY OF THE INVENTION

The present invention represents a media inverting system for a cut sheet printing system, comprising:

a first media transport for advancing a media sheet along a first media transport path in a first direction, the media sheet having a first side that contacts the first media transport and an opposing second side;

a rotatable member adapted to receive the media sheet from the first media transport at a first transfer position and rotate to advance the media sheet around the rotatable member to a second transfer position, the rotatable member having a rotation axis that is substantially parallel to the first direction, wherein the second transfer position is on an opposite side of the rotatable member from the first transfer position;

a force mechanism of the rotatable member force mechanism switchable between a first state and a second state, wherein when the force mechanism of the rotatable member force mechanism is in the first state the second side of the media sheet is held to the rotatable member, and when the force mechanism of the rotatable member force mechanism is in the second state the media sheet is released from being held to the rotatable member; and a second media transport for receiving the media sheet from the rotatable member at the second transfer position and advancing the media sheet along a second media transport path in a second direction that is substantially parallel to the first direction, the rotatable member being positioned between the first media transport and the second media transport;

wherein the first side of the transferred media sheet contacts the second media transport, and wherein an orientation of the first and second sides of the media sheet is inverted while the media sheet is advanced along the second transport path relative to an orientation of the first and second sides of the media sheet while the media sheet is advanced along the first transport path.

This invention has the advantage that the media sheet is inverted in a compact space.

It has the additional advantage that the media transports and the rotatable member can be continuously operated without the need to reverse directions, thereby providing a high throughput required for high-speed printing systems.

Figure 1:
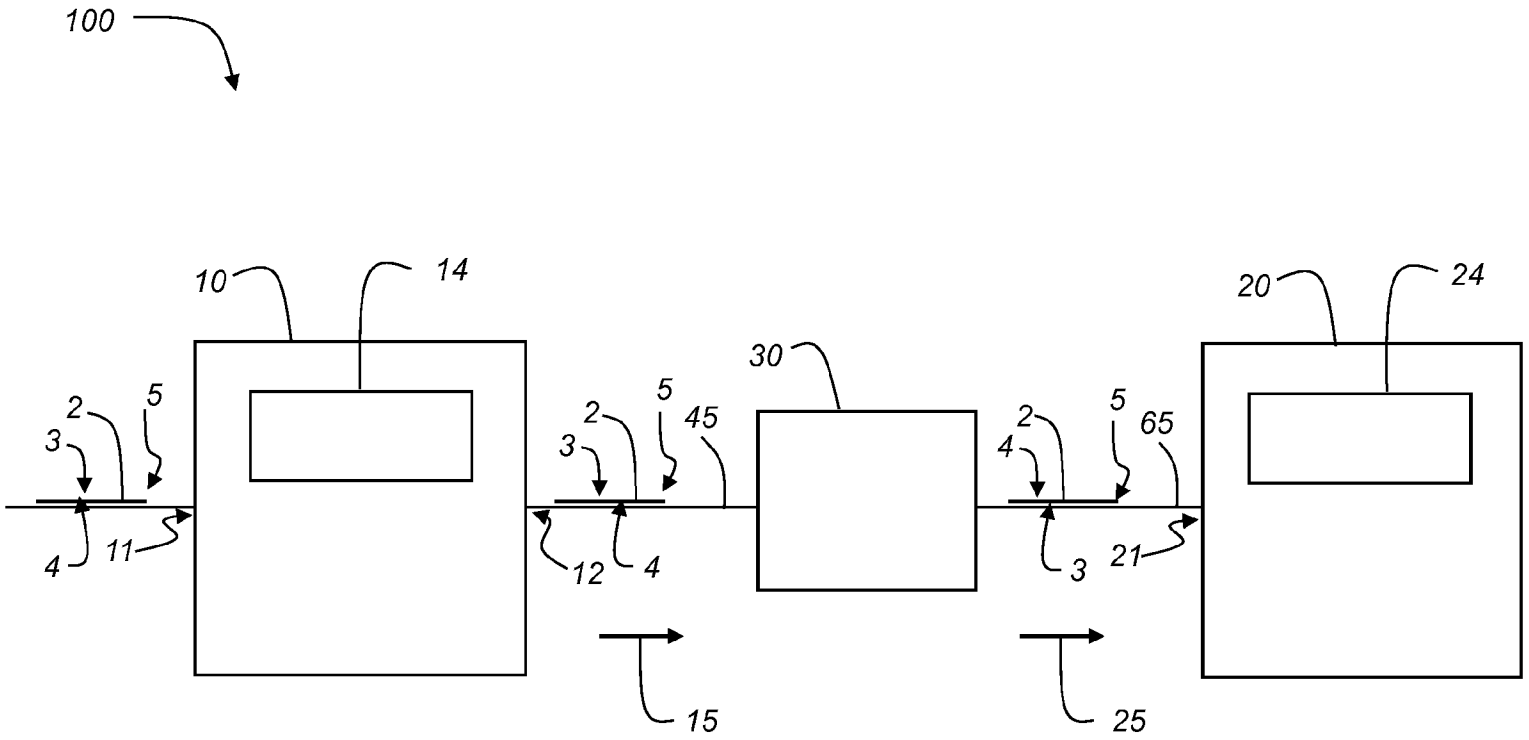
FIG. 1 shows a side view of a cut-sheet printing system including a first printing module, a media inverter and a second printing module.

It is to be understood that the attached drawings are for purposes of illustrating the concepts of the invention and may not be to scale.

DETAILED DESCRIPTION OF THE INVENTION

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and not to scale for the sake of clarity. One of ordinary skill in the art will be able to readily determine the specific size and interconnections of the elements of the example embodiments of the present invention.

Cut sheets, also referred to as media sheets, refer to individual sheets of receiver media that are moved along a transport path through a printing system (or through some other type of media handling system). Cut-sheet printing systems are commonly used for printing on sheets of paper; however, there are numerous other materials for which cut-sheet printing is appropriate. For example, the media inverter described herein is compatible with media sheets made using flexible materials such as vinyl sheets, plastic sheets, or textiles.

The terms "upstream" and "downstream" are terms of art referring to relative positions along the transport path of the receiver media; points on the receiver media move along the transport path from upstream to downstream.

Referring to FIG. 1, there is shown a simplified side view of a portion of a cut-sheet printing system 100 including a first printing module 10, a second printing module 20, and a media inverter 30 positioned downstream of first printing module 10 and upstream of second printing module 20. A media sheet 2 (sometimes referred to as a "cut sheet") is shown at input 11 and output 12 of first printing module 10, and also at input 21 of second printing module 20 after passing through media inverter 30. In this example, at output 12 of first printing module 10, a media sheet 2 is shown moving along a media transport path 45 in a first direction 15 with a first side 4 held against the media transport path 45 and an opposite second side 3 facing away from media transport path 45, and with a leading edge 5 being the most downstream edge of media sheet 2. This is the same orientation as media sheet 2 had at input 11 of first printing module 10. As media sheet 2 is moved through the first printing module 10, the media sheet is oriented so that the second side 3 is printed on by printing stations 14. After media sheet 2 exits media inverter 30, it moves along media transport path 65 in second direction 25, with the orientation of the media sheet 2 being inverted so that the second side 3 is held against media transport path 65 and the first side 4 is facing away from media transport path 65. The leading edge 5 is still the most downstream edge of media sheet 2. (While the second direction 25 is the same as the first direction 15 in this example, this is not a requirement.) Thus as media sheet 2 enters second printing module 20 at input 21 and passes through second printing module 20, first side 4 is properly oriented for printing on by printing stations 24.

Figure 2A:
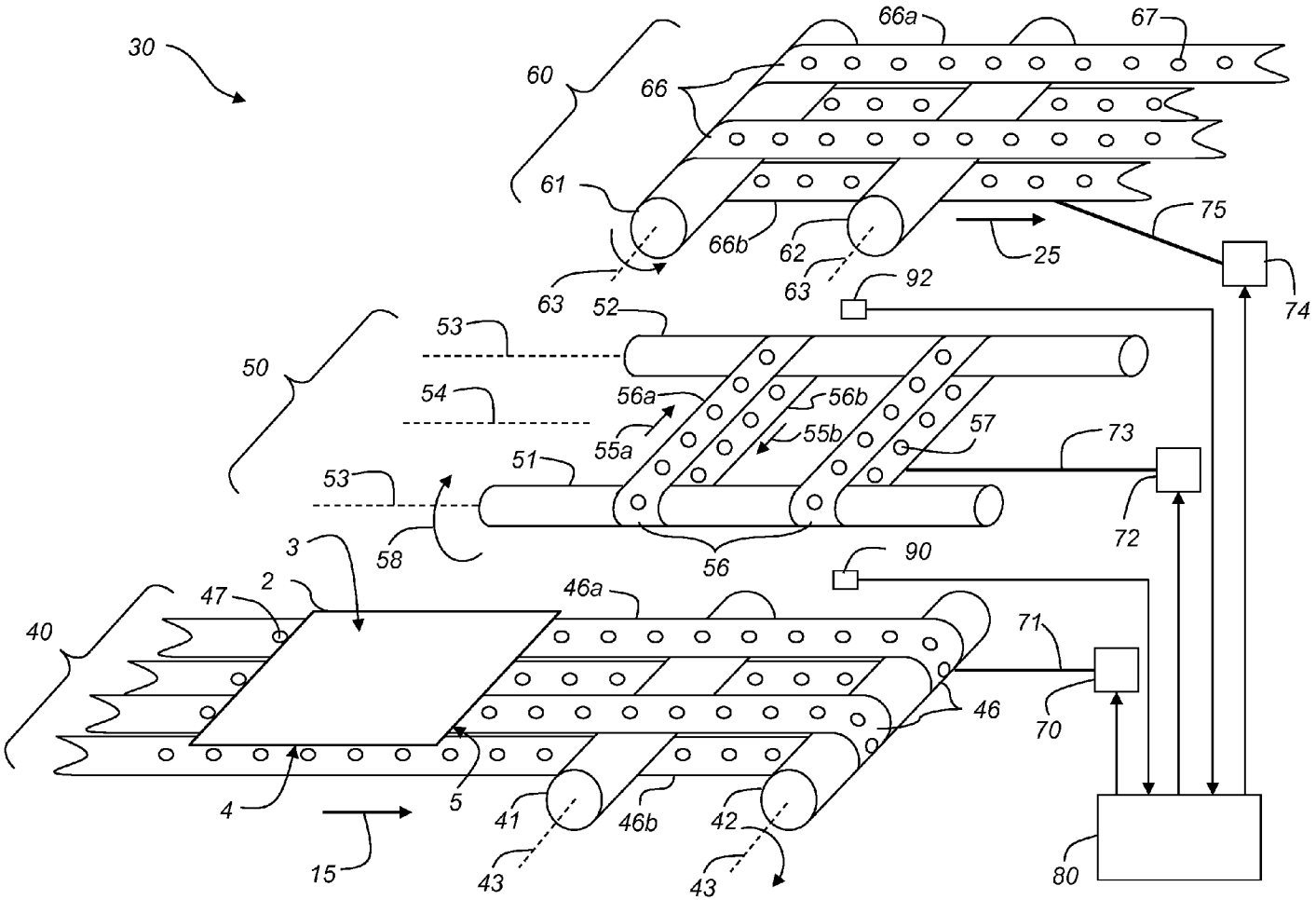
FIGS. 2A-2E show an exploded perspective of a media inverter according to an exemplary embodiment with a media sheet being advanced through an inverting process.

FIGS. 2A-2E show an exploded perspective of a media inverter 30 of the type described above relative to FIG. 1 according to an exemplary embodiment. In FIG. 2A, media sheet 2 is being advanced along a first media path by first media transport 40 in first direction 15. In this embodiment, first media transport 40 is a belt system including two belt strips 46 that travel around a first roller 41 and a second roller 42. Rollers 41 and 42 have parallel roller axes 43 that are substantially perpendicular to first direction 15. Upper belt portions 46*a* of belt strips 46 travel in first direction 15, while lower belt portions 46*b* travel in an opposite direction. In this example, it is the upper belt portions 46*a* of the belt strips 46 that define the first media path. First side 4 of media sheet 2 is in contact with upper belt portions 46*a* of belt strips 46, with second side 3 facing away from the belt strips 46.

In a preferred embodiment, the first side 4 of the media sheet 2 is held to the upper belt portions 46*a* by a vacuum force applied through vacuum holes 47. Vacuum belt systems for applying a vacuum force to a media sheet 2 to hold the media sheet 2 to the belt are well-known in the art, and any such system can be used to provide the vacuum force in accordance with the present invention. In more general terms, first media transport 40 is provided a hold-down force by first media transport force mechanism 70, where the hold-down force is applied through force transfer element 71. For example, first media transport force mechanism 70 can include a vacuum pump that can be switched on and off, and force transfer element 71 can include tubing and a plenum for applying the vacuum to vacuum holes 47 in belt strips 46. In a preferred embodiment, the first media transport force mechanism 70 is switchable between a first state and a second state. In the first state, the first side 4 of media sheet 2 is attracted to and then held by first media transport 40. In the second state of rotatable member force mechanism 72, the media sheet 2 is released from being held to the first media transport 40. Because media sheet 2 is transported horizontally on the upper belt portion 46*a* of belt strips 46, in some embodiments gravity can be used to hold the media sheet 2 onto belt strips 46 and no separate first media transport force mechanism 70 is used.

Although in this example the first media transport 40 includes a pair of belt strips 46, in other embodiments more than two belt strips 46 or a single wide belt strip 46 can be used. In FIG. 2A the belt strips 46 are shown as somewhat widely separated in order to show other portions of the apparatus more clearly. More typically the belt strips 46 would be located closer to one another to provide better support for the media sheets 2. Providing more than two belt strips 46 can be advantageous for accommodating a variety of widths of media sheets 2.

In addition to first media transport 40, the illustrated embodiment shown in FIG. 2A also includes a rotatable member 50 that is adapted to receive media sheet 2 from the first media transport 40 at a first transfer position 48 (FIG. 2B), and advance the media sheet 2 to a second transfer position 59 (FIG. 2D), thereby inverting it as is described in further detail below with reference to FIGS. 2B-2D. The illustrated embodiment shown in FIG. 2A also includes a second media transport 60 for receiving the media sheet 2 from the rotatable member 50 at the second transfer position 59 (FIG. 2D) as is described in further detail below with reference to FIGS. 2D-2E.

Rotatable member 50 is positioned between the first media transport 40 and the second media transport 60. In the exemplary embodiment of FIGS. 2A-2E the first media transport 40, the rotatable member 50 and the second media transport 60 are all belt systems including belts travelling along respective belt paths around a plurality of rollers. Such a configuration can be advantageous for successively transferring media sheet 2 from first media transport 40 to rotatable member 50 to second media transport 60 in a compact apparatus. In particular, the rotatable member 50 includes belt strips 56 with vacuum holes 57 traveling along a belt path around rollers 51, 52 with roller axes 53, and the second media transport 60 includes belt strips 66 with vacuum holes 67 traveling along a belt path around rollers 61, 62 with roller axes 63.

The rotatable member 50 has a rotatable member force mechanism 72 with force transfer element 73, and the second media transport 60 has a second media transport force mechanism 74 with force transfer element 75. In a preferred embodiment, the rotatable member force mechanism 72 is switchable between a first state and a second state. In the first state, the second side 3 of media sheet 2 is attracted to and then held by rotatable member 50. In the second state of rotatable member force mechanism 72, the media sheet 2 is released from being held to the rotatable member 50. Similarly, the second media transport force mechanism 74 is switchable between a first state and a second state. In the first state, the first side 4 of media sheet 2 is attracted to and then held by second media transport 60. In the second state of rotatable member force mechanism 72, the media sheet 2 is released from being held to the second media transport 60.

Figure 2B:
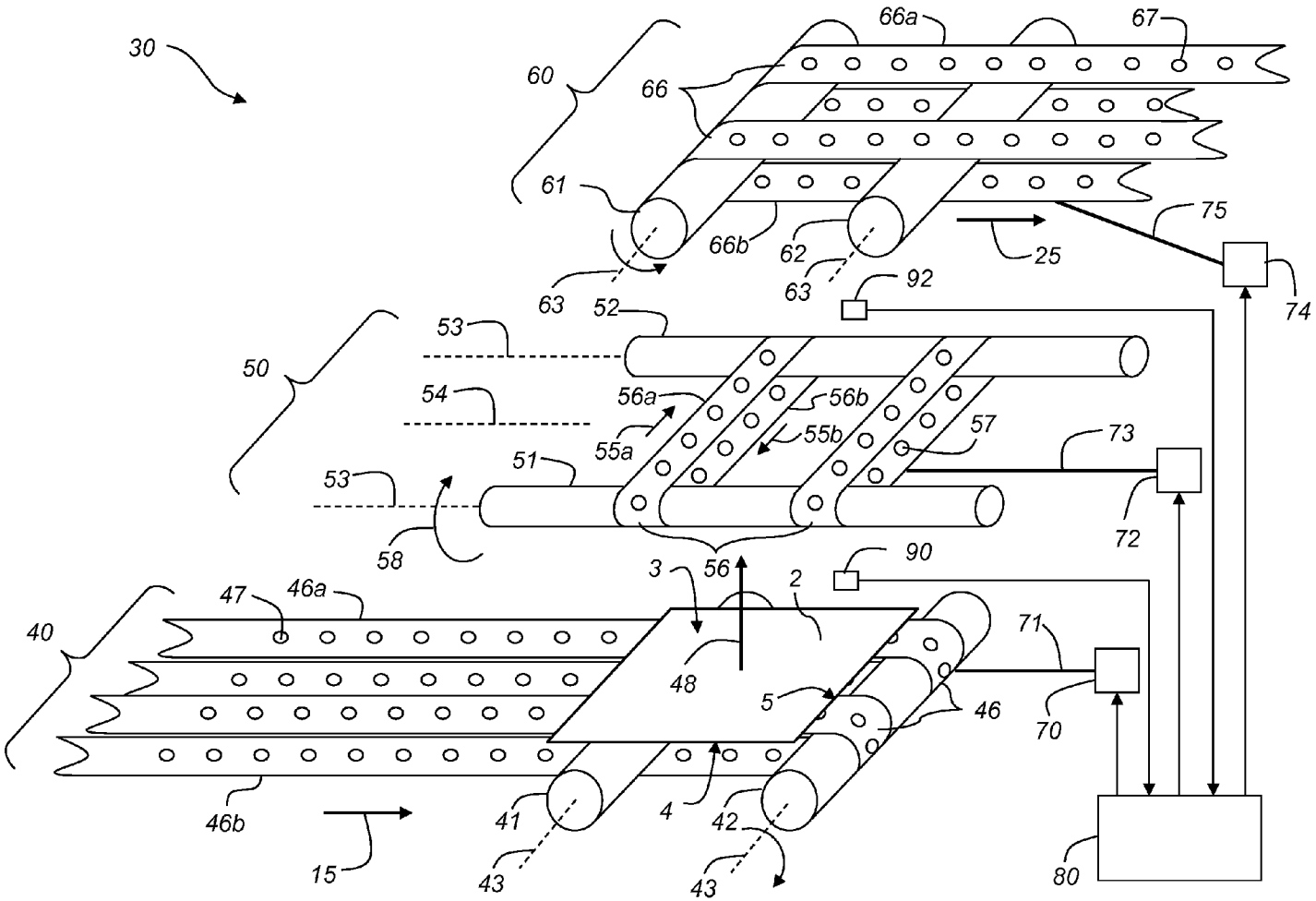

FIG. 2B shows the media inverter 30 of FIG. 2A with the media sheet 2 having arrived at first transfer position 48. Arrival at first transfer position 48 can be detected by sensor 90, which can be an optical sensor or a mechanical sensor, for example. Alternatively if first media transport force mechanism 70 includes a vacuum that is applied through force transfer element 71 to belt strips 46, the coverage of the vacuum holes 47 between first roller 41 and second roller 42 at upper belt portion 46*a* of the belt strips 46 can optionally be monitored by sensing vacuum pressure in order to determine when media sheet 2 arrives at the first transfer position 48. First transfer position 48 is indicated as an upward arrow, because when media sheet 2 arrives at the first transfer position 48, the media sheet 2 is transferred upwardly in the direction of the arrow to rotatable member 50.

When it is detected that media sheet 2 has reached first transfer position 48 (e.g., as detected by sensor 90), a controller 80 switches the first media transport force mechanism 70 from its first state to its second state to release the media sheet 2 from being held to the first media transport 40 in synchronization with switching the rotatable member force mechanism 72 to its first state, thereby attracting the media sheet 2 to the rotatable member 50 and holding it there. Switching the first media transport force mechanism 70 to its second state in synchronization with switching the rotatable member force mechanism 72 to its first state does not necessarily mean that the switching is simultaneous. In some embodiments, the switching of the rotatable member force mechanism 72 to the first state can be before or after the switching of the first media transport force mechanism 70 to the second state by some predefined time interval. Typically such a time interval would be less than 1 second, and in some embodiments would be between 0.0-0.1 seconds.

Figure 2C:
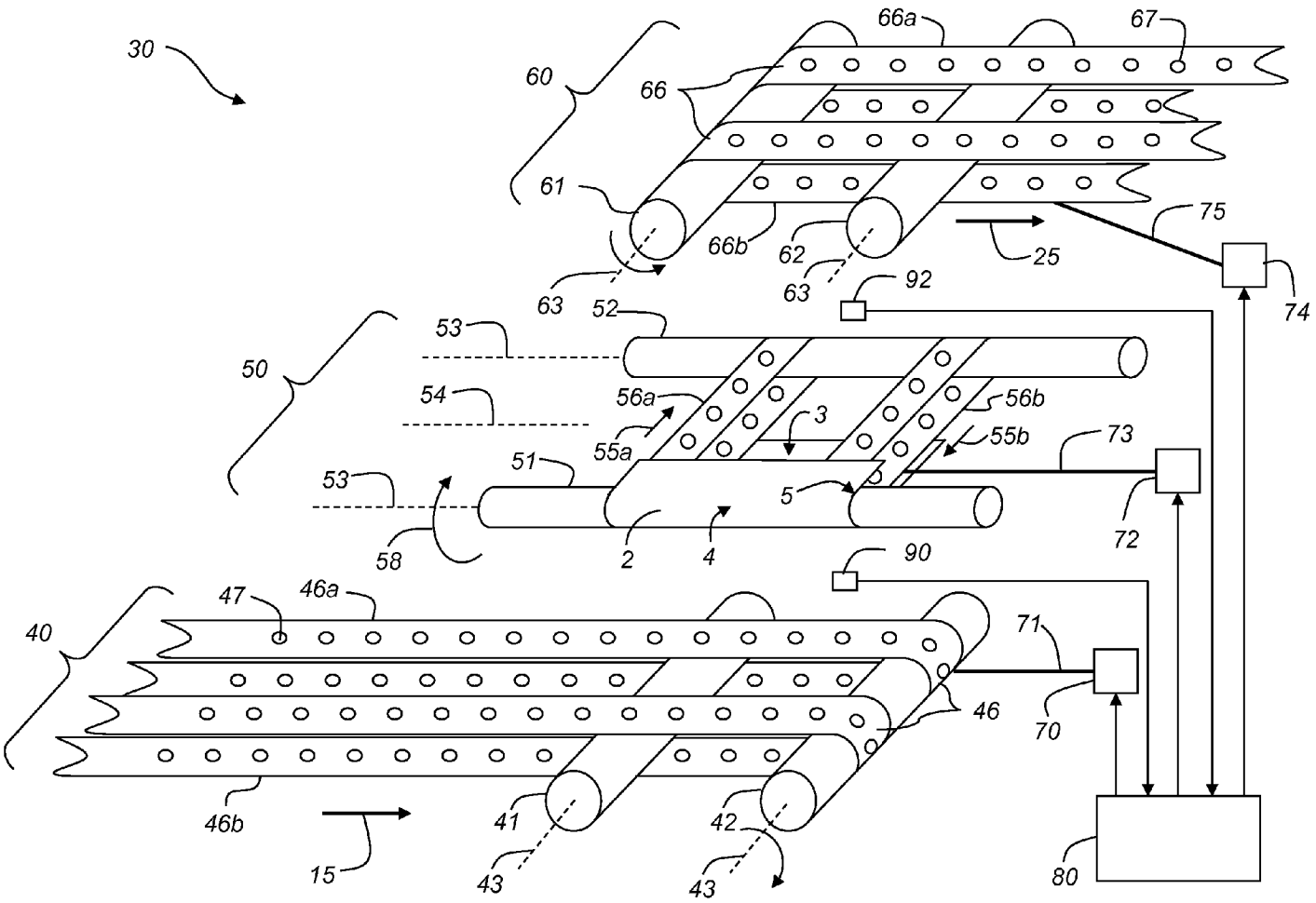

FIG. 2C shows the media inverter 30 of FIG. 2A with the media sheet 2 being rotated around rotatable member 50 toward second transfer position 59 (FIG. 2D) on the opposite side of the rotatable member 50 from the first transfer position 48 (FIG. 2B). By "opposite side" it is not necessarily meant that second transfer position 59 is directly opposite first transfer position 48, such that media sheet 2 has been rotated by a full 180° in travelling from the first transfer position 48 to the second transfer position 59, but that media sheet 2 has been rotated by more than 90°.

In the exemplary embodiment shown in FIGS. 2A-2E, the rotatable member 50 is a belt system including belt strips 56 travelling along a belt path such that lower belt portions 56*b* of belt strips 56 move in lower belt portion direction 55*b* toward a first roller 51, then rotate around roller 51 in rotation direction 58. Upper belt portions 56*a* of belt strips 56 then move in upper belt portion direction 55*a* toward a second roller 52.

In FIG. 2C, the media sheet 2 can be seen travelling with belt strips 56 as it is held to the belt strips 56 by the rotatable member force mechanism 72. Rotatable member 50 has a rotation axis 54 that is parallel to the roller axes 53 of the rollers 51, 52. It can be seen that the rotation axis 54 is substantially parallel to the first direction 15 of the first media transport 40. (By "substantially parallel" it is meant that rotation axis 54 is parallel to first direction 15 to within 10°.) It should be noted that while the rotation axis 54 is substantially parallel to first direction 15 near first transfer position 48 (FIG. 2B), it is not necessarily substantially parallel to the direction of the first media transport 40 at points along the media path farther from first transfer position 48.

In some embodiments, rotatable member 50 continuously rotates, although its speed may change. In other embodiments, the rotatable member 50 occasionally stops, for example when no media sheets 2 are in the media inverter 30 or closely approaching the media inverter 30. In a preferred embodiment, the rotatable member 50 rotates in a single direction (e.g., rotation direction 58) rather than reversing direction during the process of turning media sheet 2 over, although this is not required.

Figure 2D:
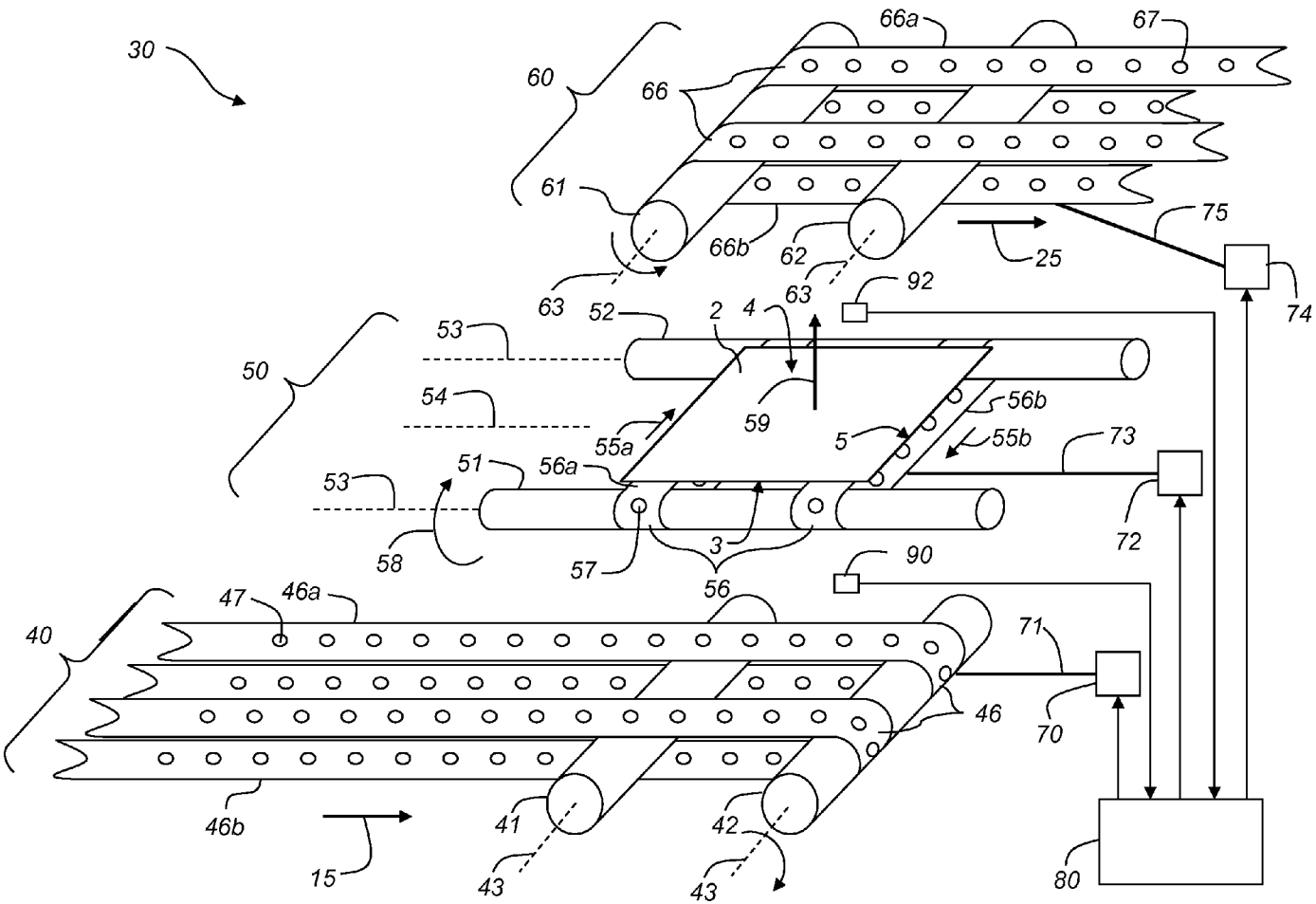

FIG. 2D shows the media inverter 30 of FIG. 2A with the media sheet 2 having arrived at the second transfer position 59. Second transfer position 59 is indicated as an upward arrow, because when media sheet 2 arrives at second transfer position 59, media sheet 2 is transferred upwardly to second media transport 60. Arrival at the second transfer position 59 can be detected by sensor 92, which can be an optical sensor or a mechanical sensor, for example. Alternatively if rotatable member force mechanism 72 includes a vacuum force that is applied through force transfer element 73 to vacuum holes 57 in belt strips 56, the coverage of vacuum holes 57 between first roller 51 and second roller 52 in upper belt portions 56*a* of the belt strips 56 can optionally be monitored by sensing vacuum pressure in order to determine when media sheet 2 arrives at the second transfer position 59.

When it is detected that the media sheet 2 has reached second transfer position 59, the rotatable member force mechanism 72 is switched from its first state to its second state, thereby releasing the media sheet 2 from being held to the rotatable member 50. In synchronization with switching the state of the rotatable member force mechanism 72, the second media transport force mechanism 74 is switched to its first state, thereby attracting the media sheet 2 and holding it to the second media transport 60. Switching the states of the second media transport force mechanism 74 and the rotatable member force mechanism 72 in synchronization does not necessarily mean that the switching is simultaneous. In some embodiments, the switching of the rotatable member force mechanism 72 to the second state can be before or after the switching of second media transport force mechanism 74 to the first state by some predefined time interval. Typically, such a time interval would be less than 1 second, and in some embodiments would be between 0.0-0.1 seconds.

Figure 2E:
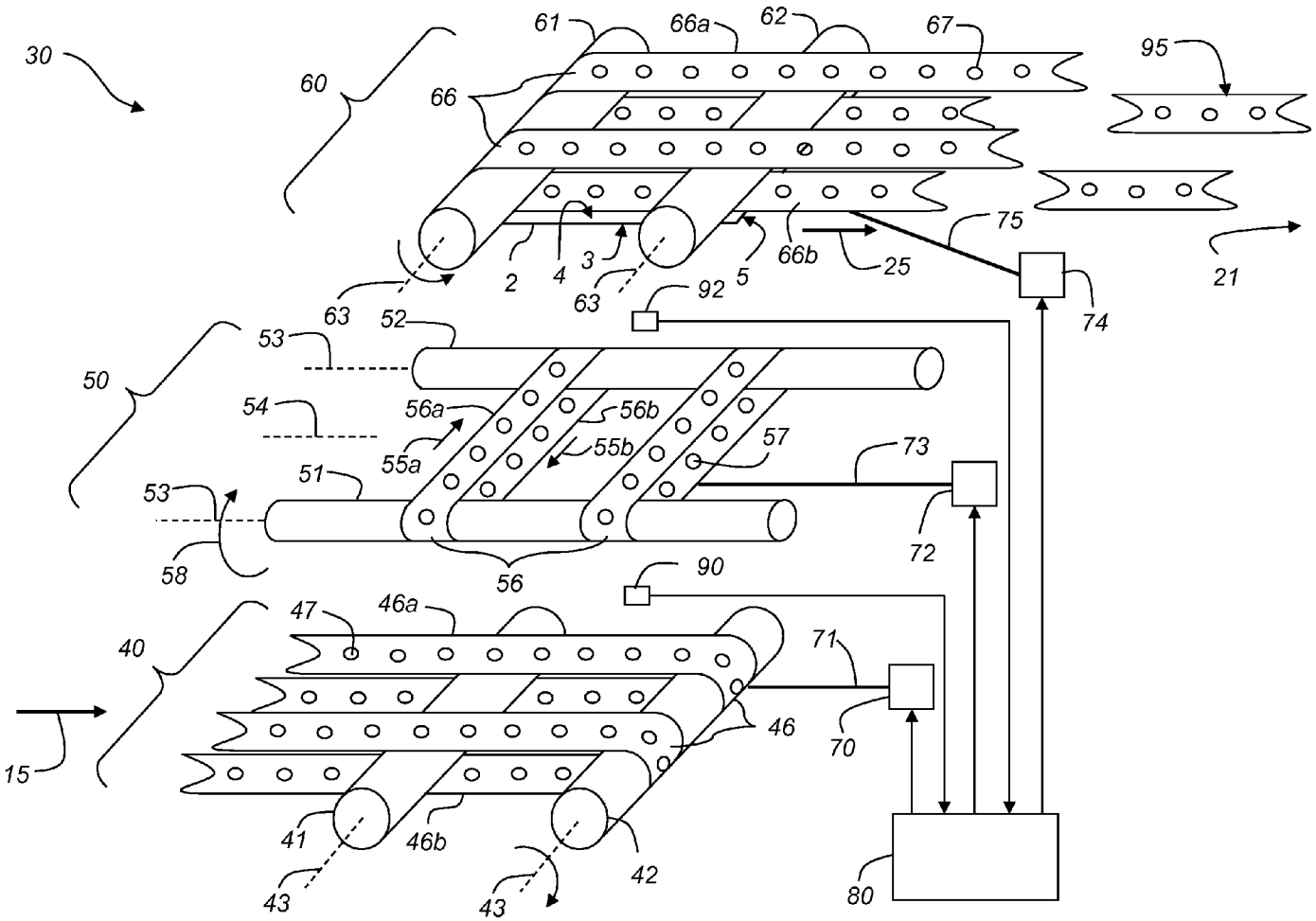

FIG. 2E shows the media inverter 30 of FIG. 2A with the media sheet 2 having been transferred to the second media transport 60. In this example, second media transport 60 includes belt strips 66 that travel around first roller 61 and second roller 62. In a preferred embodiment, the media sheet 2 is held to the belt strips 66 by applying a vacuum force from second media transport force mechanism 74 via force transfer element 75 through vacuum holes 67. In particular, first side 4 of media sheet 2 contacts lower belt portions 66*b* of belt strips 66. The media sheet 2 is then advanced in a second direction 25 that is substantially parallel to first direction 15. By "substantially" parallel it is meant that second direction 25 is parallel to first direction 15 within 10°. It should be noted that while the second direction 25 is substantially parallel to first direction 15 near second transfer position 59 (FIG. 2D), it is not necessarily substantially parallel at points along the media path farther from second transfer position 59. As will be discussed with reference to FIGS. 7A-7B, in some embodiments the second direction 25 is substantially parallel to the first direction 15, but is in the opposite direction to the first direction 15.

Comparing FIG. 2E with FIG. 2A, it can be seen that the orientation of first side 4 (facing upward in FIG. 2E and downward in FIG. 2A) and second side 4 (facing downward in FIG. 2E and upward in FIG. 2A) is inverted. It can also be seen that leading edge 5 continues to be the most downstream edge of media sheet 2. With reference also to FIG. 1, media sheet 2 can subsequently be optionally transferred to the top side of belt strips 95 that are a downstream portion of media transport path 65 leading to input 21 of second printing module 20, so that first side 4 of media sheet 2 can be printed on by corresponding printing stations 24. This transfer can take place, for example, by switching second media transport force mechanism 74 of second media transport 60 to its second state to release the media sheet 2 when it has advanced to a position above the belt strips 95. This can be done in synchronization with switching a force mechanism associated with the belt strips 95 so that the media sheet 2 is attracted to and held to the belt strips 95.

Figure 3:
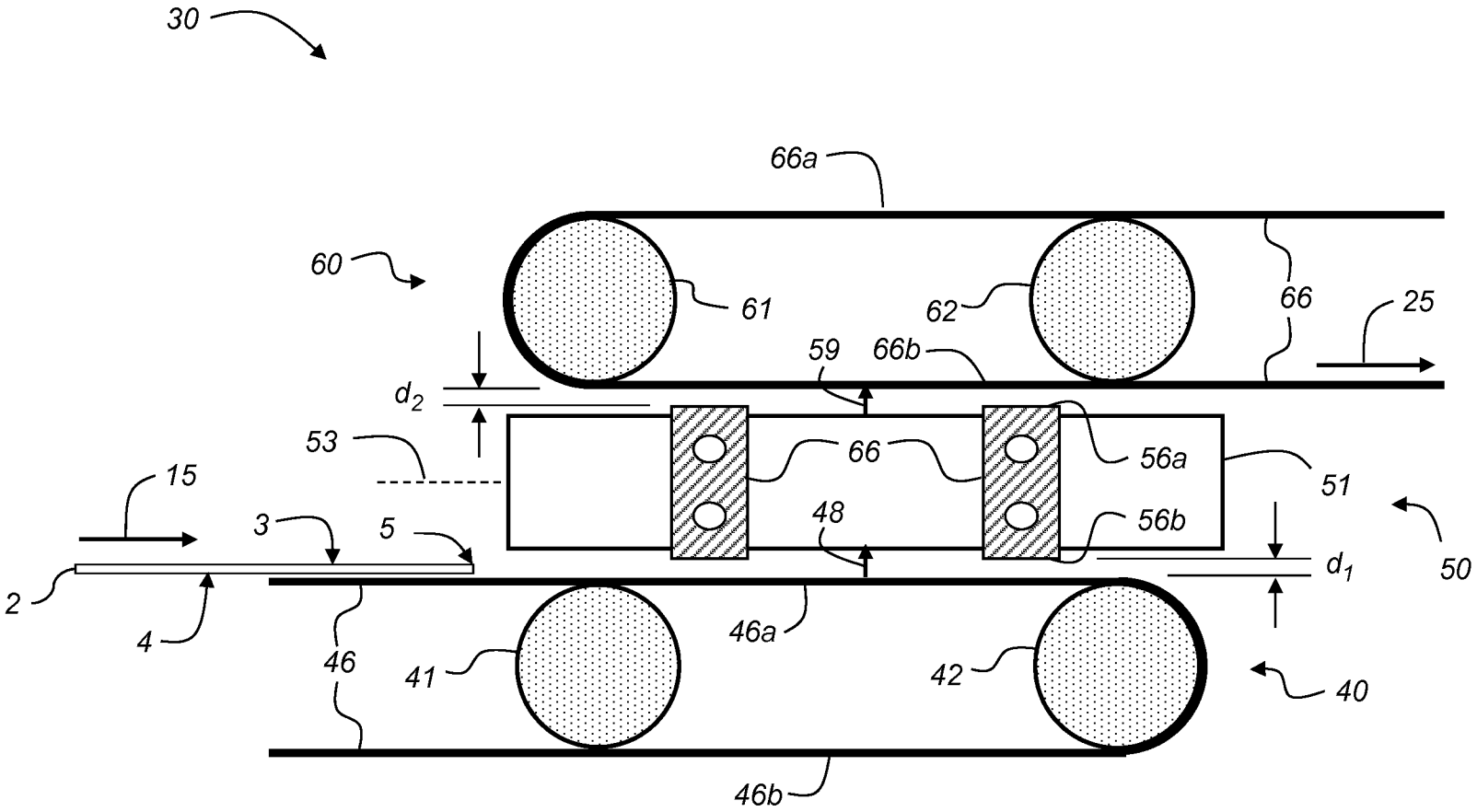
FIG. 3 is a side view of the media inverter of FIGS. 2A-2E.

The exploded perspectives of FIGS. 2A-2E are useful for showing the details of the individual components of the media inverter 30, as well as the orientation of the media sheet 2 as it travels through the media inverter 30, but the exploded perspectives do not provide an adequate appreciation of the compactness of the media inverter 30. FIG. 3 shows a non-exploded side view of the media inverter 30 of FIGS. 2A-2E. As was described above relative to FIG. 2A, media sheet 2 is advanced along first direction 15 by first media transport 40, and is transferred to rotatable member 50, which is positioned between first media transport 40 and second media transport 60. (Only the front-most roller 51 of rotatable member 50 is visible in FIG. 3.)

The upper belt portion 46*a* of belt strips 46 of first media transport 40 is spaced apart from the lower belt portion 56*b* of belt strips 56 of rotatable member 50 by a first separation distance $d_1$. Similarly the upper belt portion 56*a* of the belt strips 56 of the rotatable member 50 is spaced apart from the lower belt portion 66*b* of the belt strips 66 of the second media transport 60 by a second separation distance $d_2$. It is advantageous for the first separation distance $d_1$ and the second separation distance $d_2$ to be less than 2 cm, and preferably to be less than 1 cm in order to facilitate the transfer of media sheet 2 from the first media transport 40 to the rotatable member 50 to the second media transport 60. The belt system embodiments of media inverter 30 shown in FIGS. 2A-2E and FIG. 3 with rotatable member 50 being positioned at a close spacing from the first media transport 40 and the second media transport 60 can be advantageously compact both horizontally and vertically.

By contrast U.S. Pat. No. 4,019,435 to Davis, entitled "Sheet inverting," shows an inverter having lower conveyor belts positioned below the first media transport and upper conveyor belts positioned above the second media transport. The turnover mechanism includes an arcuate surface along which the sheets are driven by the lower conveyor belts until they are handed off to the upper conveyor belts. Such a media inverter has the disadvantage that it is not as compact as embodiments of the present invention, especially in the vertical direction. In addition, some types of media sheets do not have appropriate stiffness or have too short of a length to be pushed around arcuate surface. To solve this problem, the rotatable member 50 in the embodiment of the present invention described above holds onto the media sheet 2 across its surface as the media sheet 2 is being inverted.

U.S. Pat. No. 4,027,870 to Frech et al., entitled "End for end document inverter," shows a media transport in the form of a first belt that transfers a document to an inverting mechanism. Inverting mechanism uses a second belt at right angles to the first belt. Transfer from the upper side of first belt to the lower side of the second belt occurs as vacuum is turned off for the first belt and turned on for the second belt. The second belt then moves the document to a drum, which turns the document over and transfers the inverted document back to the lower side of the second belt. The second belt then reverses direction and returns inverted document to the first belt. The described inverting mechanism is compact vertically, but is not compact horizontally. In addition, because the second belt reverses direction requiring deceleration and acceleration times, the inverting mechanism is inherently slower than embodiments of the present invention, where the rotatable member 50 can rotate constantly in a single direction.

Referring again to the example shown in FIGS. 2A-2E, the controller 80 is used for controlling various components of the media inverter 30. An example of a control sequence that can be used by controller 80 includes a) controlling the first media transport 40 to advance the media sheet 2 in the first direction 15 to the first transfer position (as sensed for example by sensor 90); b) switching the rotatable member force mechanism 72 to its first state in synchronization with switching the first media transport force mechanism 70 to its second state to transfer the media sheet 2 from the first media transport 40 to the rotatable member 50 and hold the second side 3 of the media sheet 2 to the rotatable member 50; c) controlling the rotatable member 50 to advance the media sheet 2 around the rotatable member 50 to the second transfer position 59 (as sensed for example by sensor 92); d) switching the rotatable member force mechanism 72 to its second state in synchronization with switching the second media transport force mechanism 74 to its first state to release the media sheet 2 from being held to the rotatable member 50 and transfer the media sheet 2 to the second media transport 60 and hold the first side 4 of the media sheet 2 to the second media transport 60; and e) controlling the second media transport 60 to advance the inverted media sheet 2 in the second direction 25.

In the previous examples, the first media transport force mechanism 70, rotatable member force mechanism 72 and second media transport force mechanism 74 are vacuum force mechanisms that can be switched on (i.e., switched to a first state) or off (i.e., switched to a second state). In other words, in the first state an attractive vacuum force holds the media sheet 2 to the respective first media transport 40, rotatable member 50, or second media transport 60, and in the second state the attractive force holding the media sheet 2 is removed, thereby passively releasing media sheet 2 from being held to rotatable member 50. In some embodiments, at least one of the first media transport force mechanism 70, rotatable member force mechanism 72 and second media transport force mechanism 74 provides a repelling force in the second state. For example, in some embodiments, the rotatable member force mechanism 72 includes a vacuum source that applies an attractive force by providing suction at vacuum holes 57 in the first state, and an air source for blowing air through vacuum holes 57 onto the second side 3 of media sheet 2 in the second state, thereby actively releasing media sheet 2 from being held to rotatable member 50.

Figure 4A:
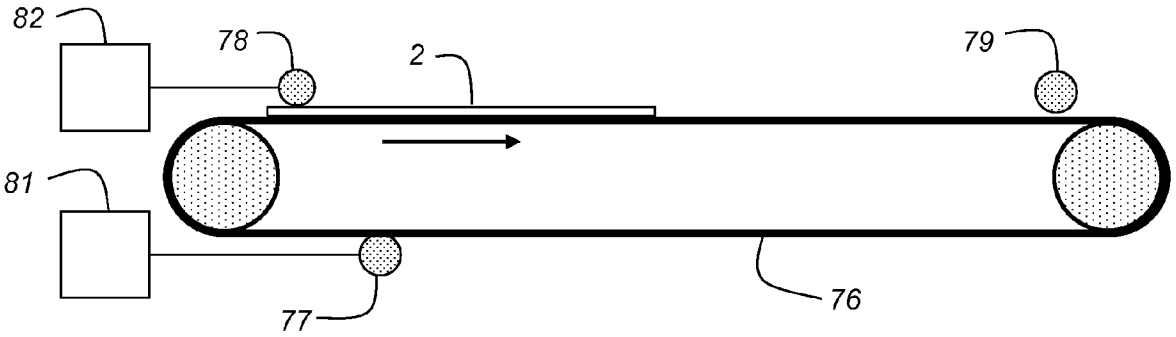
FIGS. 4A-4B are side views of belt systems where the hold down force for the media sheet is provided electrostatically by charging rollers and by corona charging units, respectively.

Alternatively, one or more of the first media transport force mechanism 70, rotatable member force mechanism 72 and second media transport force mechanism 74 can provide an electrostatic hold down force. FIG. 4A shows a belt 76 having an electrically insulating surface. A belt charging roller 77 is provided a high voltage by voltage source 81 and applies a charge to the electrically insulating surface of belt 76. A sheet charging roller 78 is provided a high voltage of the opposite polarity by voltage source 82 to charge the media sheet 2 with an opposite charge, so that the media sheet 2 is attracted to the belt 76, thereby providing the first state. A discharging roller 79 is connected to ground and bleeds charge off at least one of the belt 76 and the media sheet 2, thereby removing the attractive force and providing the second state.

Figure 4B:
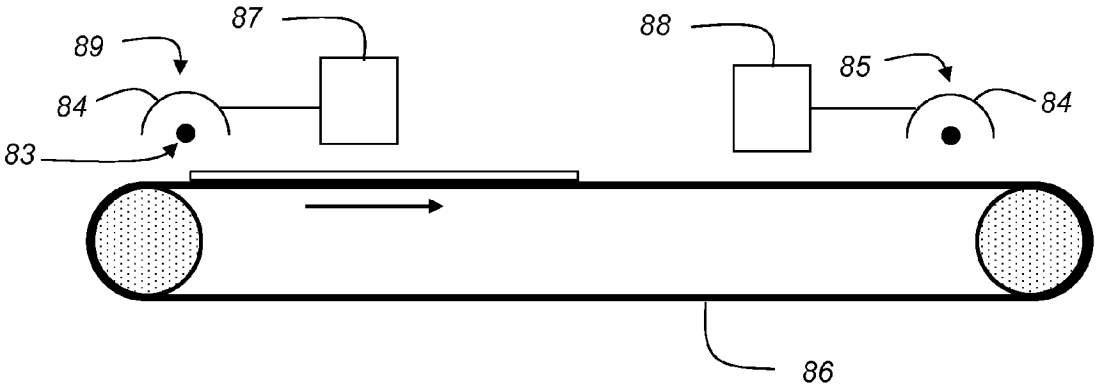

FIG. 4B shows another embodiment of an electrostatic hold down belt system where non-contact corona units are used for supplying the charge (to provide the first state) and for neutralizing the charge (to provide the second state). Belt 86 has an electrically insulating surface. At least one corona charging unit 89 includes a wire 83 that is provided a high DC voltage by DC voltage source 87. Typically, a shield 84 partially surrounds the wire 83 but is open where the corona charging unit 89 faces belt 86. The high voltage causes ionization and charged particles (electrons or ions) are showered onto the belt 86 or the media sheet 2 to provide the attractive force. Optionally a grid (not shown) between wire 83 and belt 86 can be used to control the rate of flow of charge from the corona charging unit 89. A corona discharging unit 85 is provided a high AC voltage by an AC voltage source 88. Charges of both signs are directed toward at least one of the media sheet 2 and the belt 86. Charges of the same polarity as the charge on the media sheet 2 or the belt 86 are repelled, while opposite polarity charges are attracted, thereby at least partially neutralizing the charge and removing the attractive force.

Figure 5:
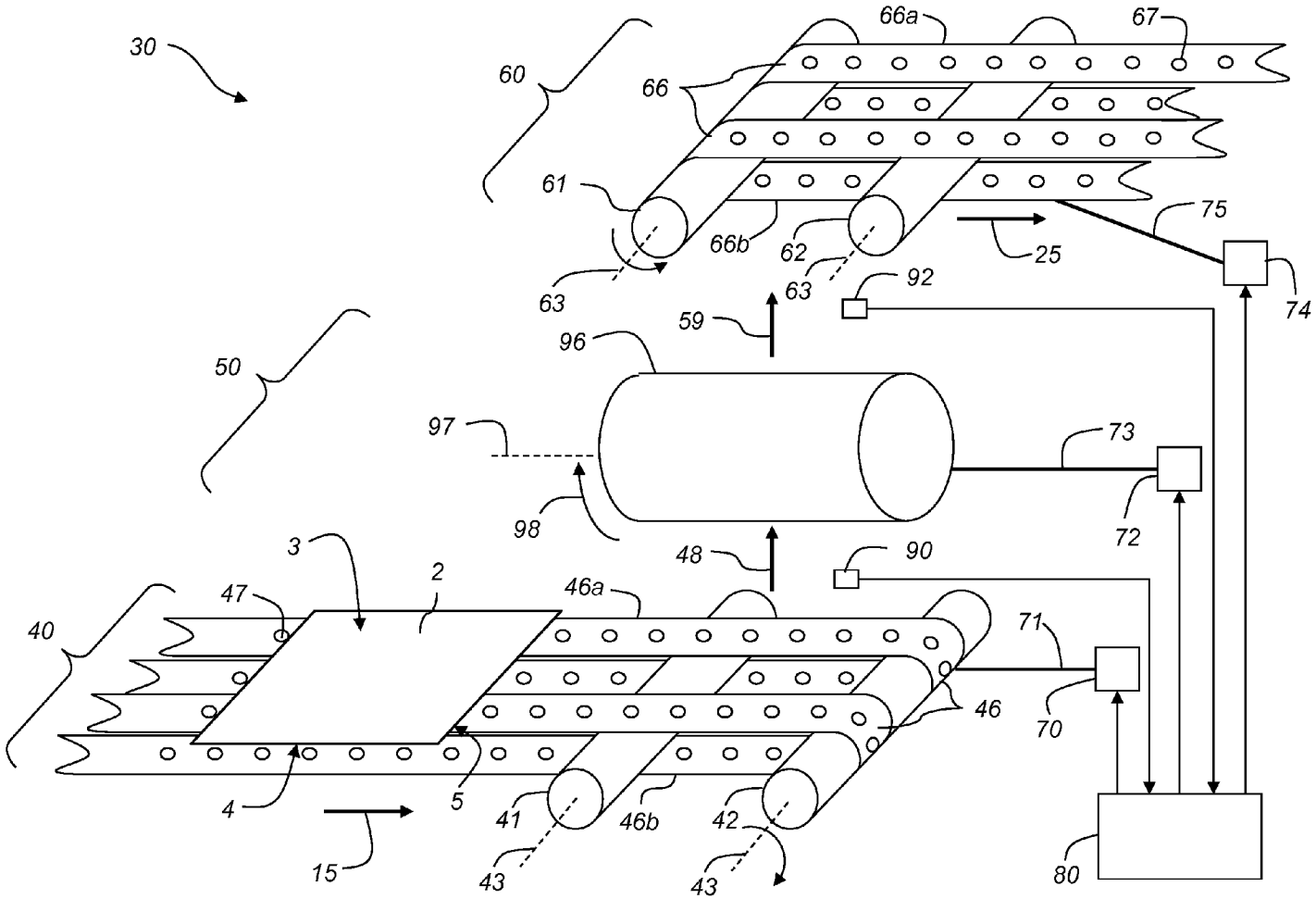
FIG. 5 is an exploded perspective of a media inverter according to an alternate embodiment where the rotatable member is a drum.

In the embodiments described above, rotatable member 50 is a belt system. FIG. 5 shows an exploded perspective of a media inverter 30 similar to that of FIGS. 2A-2E, but where the rotatable member 50 is a drum 96 having a drum axis 97. The drum 96 rotates about the drum axis 97 in a rotation direction 98 to invert media sheet 2 from its orientation at first transfer position 48 to an opposite orientation at the second transfer position 59.

Figure 6:
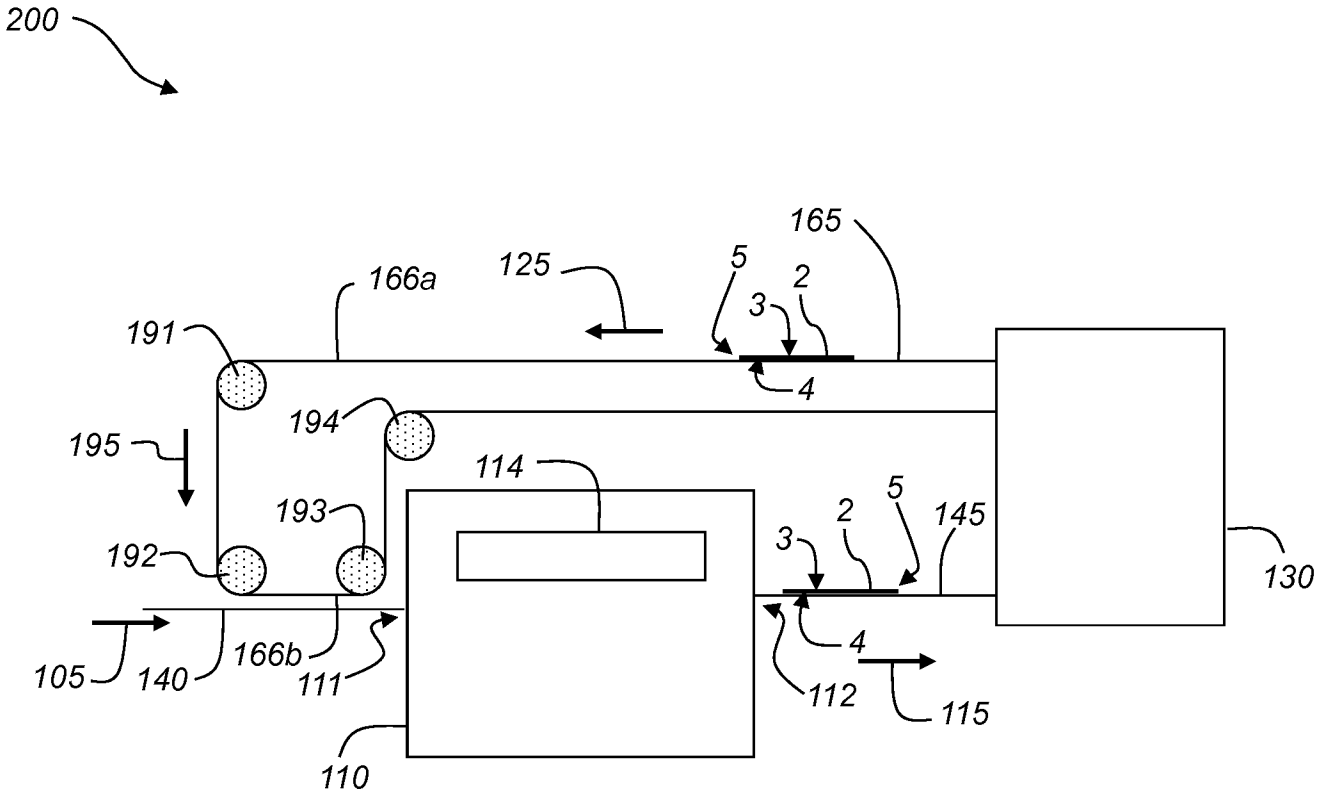
FIG. 6 shows a side view of a cut-sheet printing system including a printing module and a media inverter that inverts media sheets and returns them to the input of the printing module.

Cut-sheet printing system 100 described above with reference to FIG. 1 has a media inverter 30 between first printing module 10 and second printing module 20. Such a printing system is advantageous for very high printing throughput. Referring to FIG. 6, there is shown a simplified side view of a portion of cut-sheet printing system 200 according to an alternate configuration. In this case, the cut-sheet printing system 200 includes a printing module 110 having printing stations 114. The media sheet 2 enters the printing module 110 along an initial media transport path 140 at input 111, and exits at output 112. A media inverter 130 is provided for inverting a media sheet 2 and returning it to input 111 of printing module 110. Such a printing system is still capable of high printing throughput but has further advantages of lower cost and smaller overall size.

For clarity, the original orientation of media sheet 2 at input 111 of printing module 110 is not shown in FIG. 6 as it enters printing module 110 in entry direction 105, but (similar to FIG. 1) it is the same as the orientation at output 112 after second side 3 of media sheet 2 has been printed on by printing stations 114, such that first side 4 faces down, second side 3 faces up and leading edge 5 is the most downstream edge.

Media sheet 2 enters the media inverter 130 along first media transport path 145 in first direction 115 and exits the media inverter 130 along second media transport path 165 in a second direction 125, which is opposite the first direction 115. Media inverter 130 inverts the media sheet 2 such that at its exit onto second media transport path 165, the second side 3 still faces up and first side 4 still faces down. However, the orientation of the leading edge 5 has been inverted so that it is still the most downstream edge, even though media sheet 2 is traveling in the opposite direction.

Figure 7A:
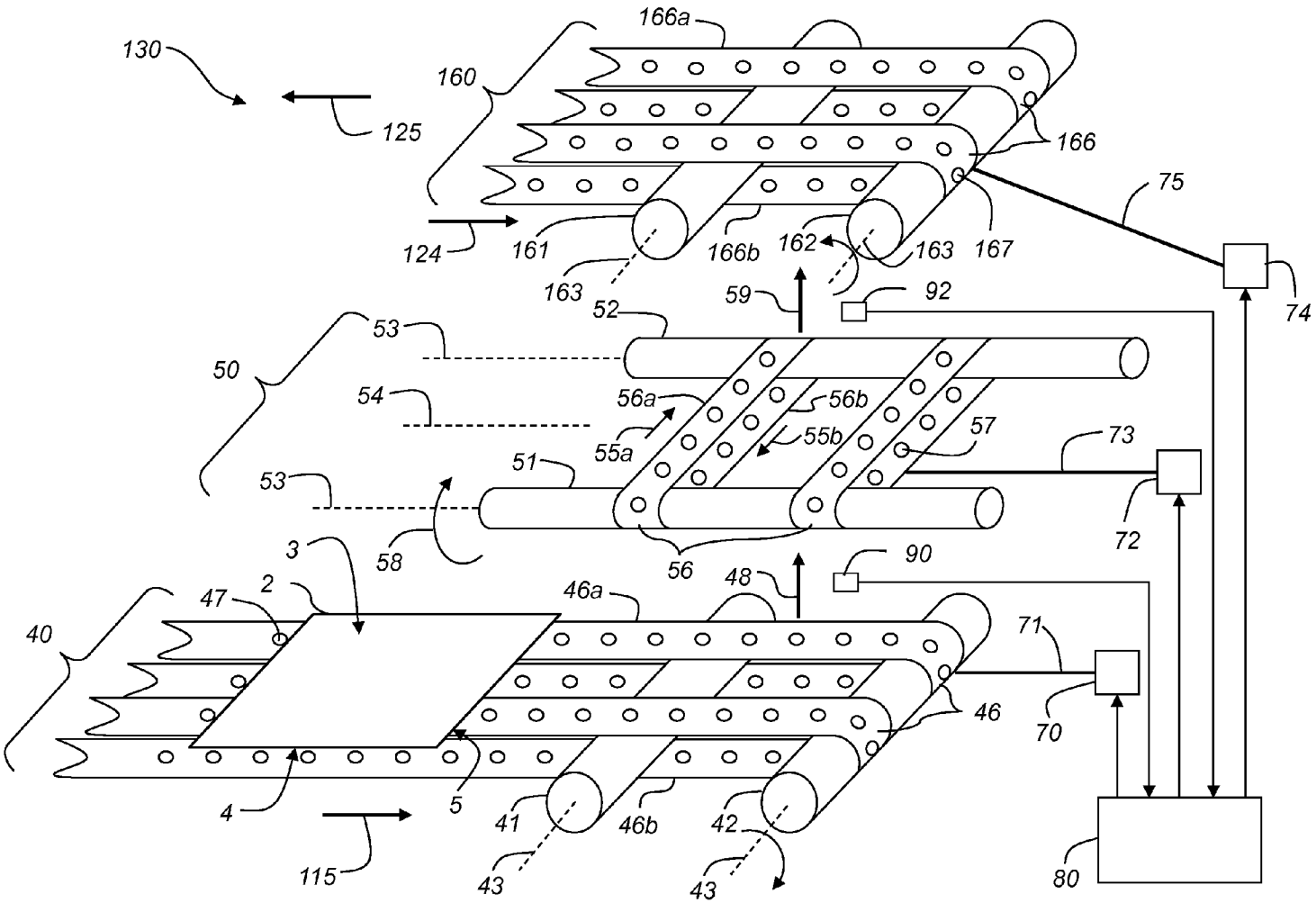
FIGS. 7A-7B show an exploded perspective of the media inverter of FIG. 6 according to an exemplary embodiment with a media sheet being advanced through an inverting process.
Figure 7B:
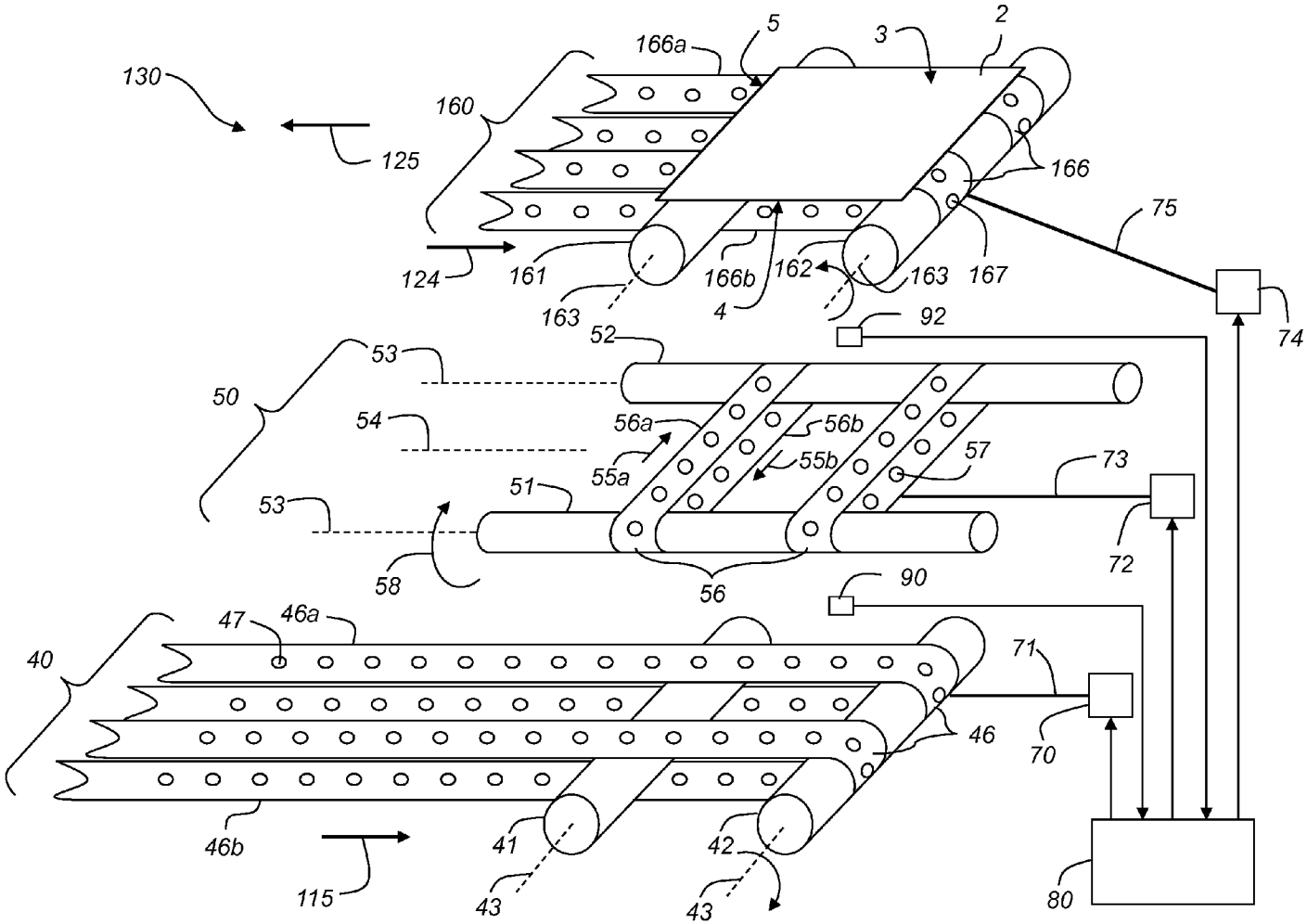

FIGS. 7A-7B show an exploded perspective of a media inverter 130 of the type described above relative to FIG. 6 according to an exemplary embodiment. In this configuration, second media transport 160 includes belt strips 166 that travel around a rollers 161, 162 having roller axes 163. In an exemplary embodiment, the belt strips 166 include vacuum holes 167 for providing a vacuum force supplied by second media transport force mechanism 74. Media sheet 2 is transferred from the rotatable member 50 to the underside of lower belt portion 166*b* at second transfer position 59 in similar fashion as described above with reference to FIG. 2D. However, in this embodiment, the media sheet 2 is initially advanced along in an initial direction 124 (which is the same as the first direction 115) toward roller 162. The media sheet 2 is then rotated around the roller 162 thereby bringing the media sheet to the top of the second media transport 160 so that the first side 4 of media sheet 2 is held to the top side of upper belt portion 166*a* with second side 3 facing up as shown in FIG. 7B. The media sheet 2 is then carried by the second media transport 160 in a second direction 125, which is reversed relative to the first direction 115.

With reference again to FIG. 6, as the media sheet 2 exits the media inverter 130, it is advanced along a second media transport path 165, with the first side 4 of media sheet 2 being held to the upper side of upper belt portion 166*a*. The media sheet 2 is carried around first turn roller 191 and then travels in a return direction 195 toward second turn roller 192. After turning around the second turn roller 192, the first side 4 of media sheet 2 is now held to the underside of lower belt portion 166*b*, with the leading edge 5 continuing to be the most downstream edge. At this point, the media sheet 2 is advancing again in the original entry direction 105. By switching off the holding force (at least locally) for lower belt portion 166*b*, the media sheet 2 is released and is transferred to the initial media transport path 140, where it enters input 111 of printing module 110 for a second time, this time with the second side 4 facing upward for printing on by the printing stations 114. In this way, a compact system is provided where a single printing module 110 is used to print on both sides of the media sheet 2. The belt continues around third turn roller 193 and fourth turn roller 194, and returns to the media inverter 130.

Figure 8A:
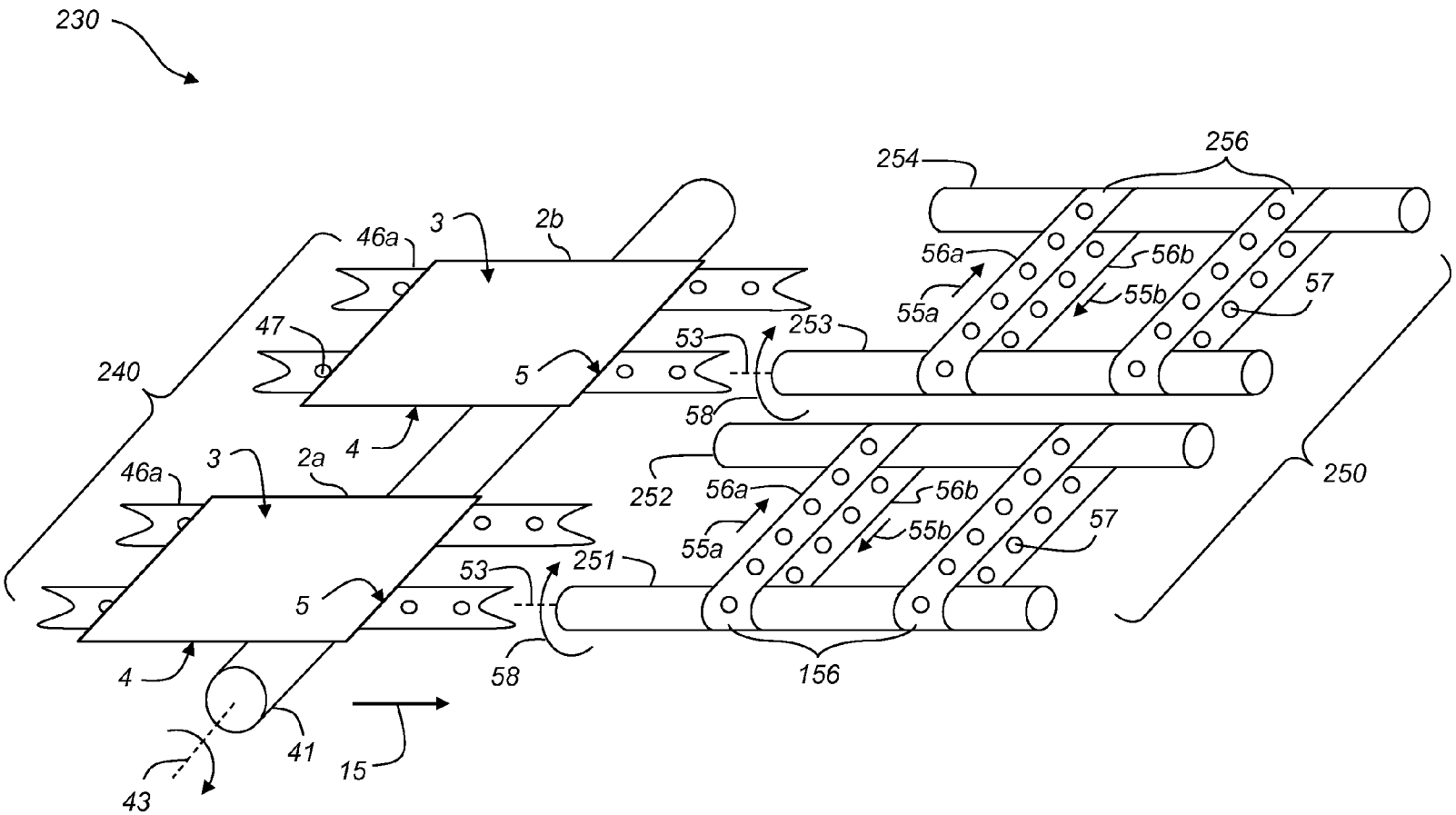
FIGS. 8A-8B show an exploded perspective of a portion of a media inverter capable of inverting two adjacent media sheets at the same time.
Figure 8B:
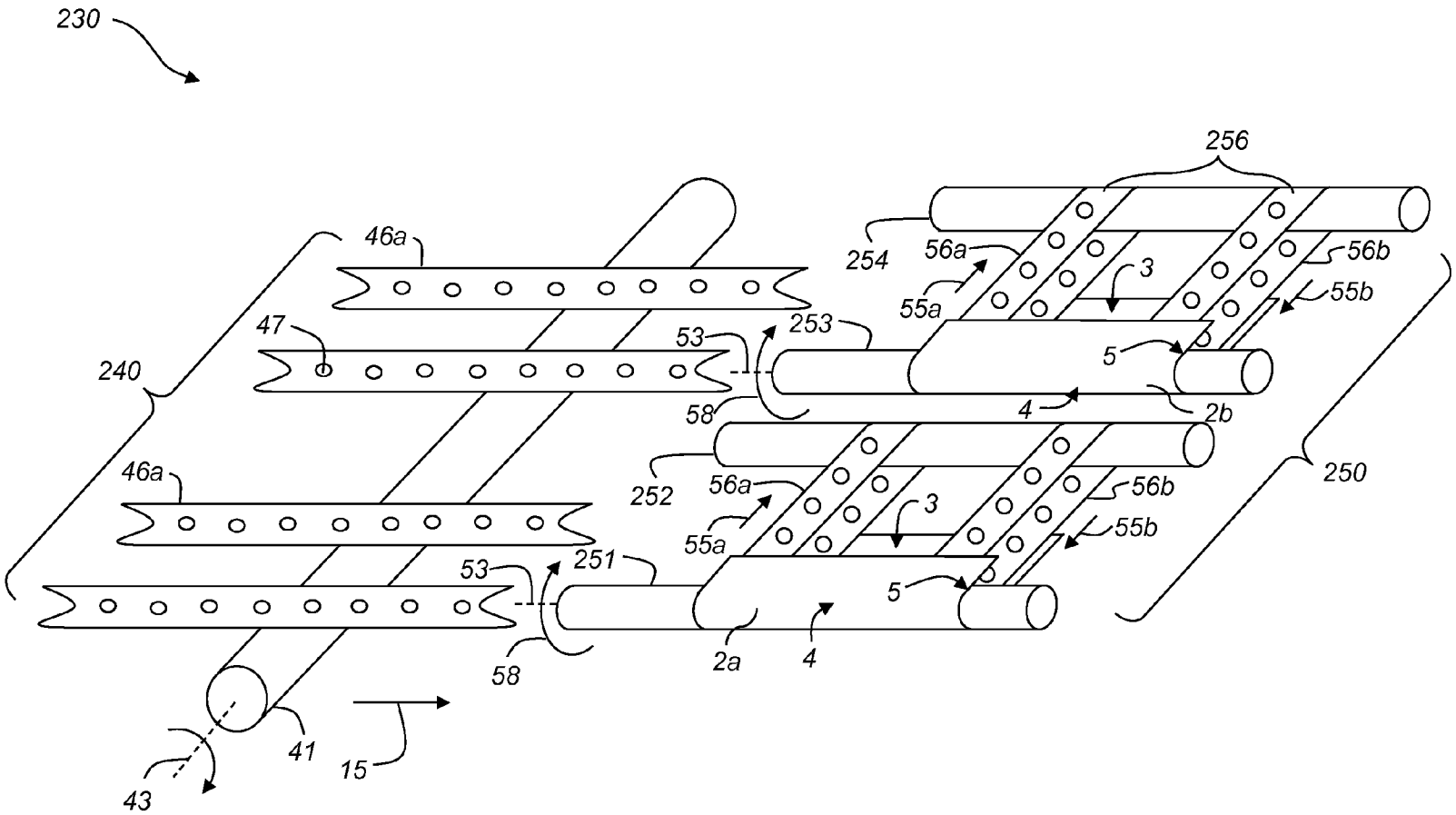

FIGS. 8A-8B show exploded perspectives of a portion of a media inverter 230 having increased throughput according to another exemplary embodiment. In this configuration, a first media transport 240 includes four belt strips, the upper belt portions 46*a* of which are shown carrying a first media sheet 2*a* and a second media sheet 2*b* adjacent one another in a tandem arrangement. As in the embodiment of FIGS. 2A-2E, the first side 4 of first media sheet 2*a* and second media sheet 2*b* is in contact with upper belt portions 46*a* of the belt strips. Rotatable member 250 includes a first set of belt strips 156 that travel around first roller 251 and second roller 252, as well as a second set of belt strips 256 that travel around third roller 253 and fourth roller 254. The first set of belt strips 156 are spaced apart from the second set of belt strips 256 such that the media sheets 2*a*, 2*b* can be transferred to rotatable member 250 and inverted at the same time as shown in FIG. 8B. As the media sheets 2*a*, 2*b* are carried around the rotatable member 250, the second side 3 of first media sheet 2*a* is in contact with belt strips 156 and the second side 3 of second media sheet 2*b* is in contact with belt strips 256. First media sheet 2*a* is turned over by travelling around first roller 251 in rotation direction 58, while second media sheet 2*b* is turned over by travelling around third roller 253 in rotation direction 58. The second media transport of media inverter 230 is not shown, but can also have four belt strips, for example, similar to first media transport 240. Other details of the media inversion process are similar to that described earlier with respect to FIGS. 2A-2E.

The invention has been described in detail with particular reference to certain preferred embodiments thereof, but it will be understood that variations and modifications can be effected within the spirit and scope of the invention.

PARTS LIST

2 media sheet
2*a* first media sheet
2*b* second media sheet
3 second side
4 first side
5 leading edge
10 first printing module
11 input
12 output
14 printing stations
15 first direction
20 second printing module
21 input
24 printing stations
25 second direction
30 media inverter
40 first media transport
41 roller
42 roller
43 roller axis
45 media transport path
46 belt strips
46*a* upper belt portion
46*b* lower belt portion
47 vacuum holes
48 first transfer position
50 rotatable member
51 roller
52 roller
53 roller axis
54 rotation axis
55*a* upper belt portion direction
55*b* lower belt portion direction
56 belt strips
56*a* upper belt portion (rotatable member)
56*b* lower belt portion (rotatable member)
57 vacuum holes
58 rotation direction
59 second transfer position
60 second media transport
61 roller
62 roller
63 roller axis
65 media transport path
66 belt strips
66*a* upper belt portion
66*b* lower belt portion
67 vacuum holes
70 first media transport force mechanism
71 force transfer element
72 rotatable member force mechanism
73 force transfer element
74 second media transport force mechanism
75 force transfer element

76 belt
77 belt charging roller
78 sheet charging roller
79 discharging roller
80 controller
81 voltage source
82 voltage source
83 wire
84 shield
85 corona discharging unit
86 belt
87 DC voltage source
88 AC voltage source
89 corona charging unit
90 sensor
92 sensor
95 belt strips
96 drum
97 drum axis
98 rotation direction
100 cut-sheet printing system
105 entry direction
110 printing module
111 input
112 output
114 printing stations
115 first direction
124 initial direction
125 second direction
130 media inverter
140 initial media transport path
145 first media transport path
156*a* belt strips
156*b* belt strips
160 second media transport
161 roller
162 roller
163 roller axis
165 second media transport path
166 belt strips
166*a* upper belt portion
166*b* lower belt portion
167 vacuum hole
191 first turn roller
192 second turn roller
193 third turn roller
194 fourth turn roller
195 return direction
200 cut-sheet printing system
230 media inverter
240 first media transport
250 rotatable member
251 roller
252 roller
253 roller
254 roller
256 belt strips
$d_1$ first separation distance
$d_2$ second separation distance

The invention claimed is:

1. A media inverting system for a cut sheet printing system, comprising:

a first media transport for advancing a media sheet along a first media transport path in a first direction, the media sheet having a first side that contacts the first media transport and an opposing second side;

a rotatable member adapted to receive the media sheet from the first media transport at a first transfer position and rotate to advance the media sheet around the rotatable member to a second transfer position, the rotatable member having a rotation axis that is substantially parallel to the first direction, wherein the second transfer position is on an opposite side of the rotatable member from the first transfer position, wherein the rotatable member is a belt system including a belt travelling along a belt path around a plurality of rollers having substantially parallel roller axes, and wherein the rotation axis is substantially parallel to the roller axes;

a rotatable member force mechanism switchable between a first state and a second state, wherein when the rotatable member force mechanism is in the first state the second side of the media sheet is held to the rotatable member, and when the rotatable member force mechanism is in the second state the media sheet is released from being held to the rotatable member; and a second media transport for receiving the media sheet from the rotatable member at the second transfer position and advancing the media sheet along a second media transport path in a second direction that is substantially parallel to the first direction, the rotatable member being positioned between the first media transport and the second media transport;

wherein the first side of the transferred media sheet contacts the second media transport, and wherein an orientation of the first and second sides of the media sheet is inverted while the media sheet is advanced along the second transport path relative to an orientation of the first and second sides of the media sheet while the media sheet is advanced along the first transport path.

2. The media inverting system of claim 1 further including a control mechanism for controlling the rotatable member and the rotatable member force mechanism according to a control sequence including:

switching the rotatable member force mechanism to the first state to transfer the media sheet from the first media transport to the rotatable member and hold the second side of the media sheet to the rotatable member while it is advanced around the rotatable member;

rotating the rotatable member to advance the media sheet around the rotatable member to the second transfer position; and switching the rotatable member force mechanism to the second state to release the media sheet from being held to the rotatable member in synchronization with the media sheet being transferred to the second media transport.

3. The media inverting system of claim 1 wherein the rotatable member continuously rotates.

4. The media inverting system of claim 1 wherein the rotatable member force mechanism is a vacuum force mechanism that provides a vacuum force in the first state to hold the second side of the media sheet to the rotatable member.

5. The media inverting system of claim 4 wherein the rotatable member force mechanism blows air through holes in the rotatable member onto the second side of media sheet in the second state, thereby actively releasing the media sheet from being held to the rotatable member.

6. The media inverting system of claim 1 wherein the rotatable member force mechanism is an electrostatic force mechanism that provides an electrostatic force in the first state to hold the second side of the media sheet to the rotatable member.

7. The media inverting system of claim 1 wherein the rotatable member force mechanism provides an attractive force between the media sheet and the rotatable member in the first state and a repelling force between the media sheet and the rotatable member in the second state.

8. The media inverting system of claim 1 further including a first media transport force mechanism for holding the first side of the media sheet to the first media transport.

9. The media inverting system of claim 8 wherein the first media transport force mechanism is a vacuum force mechanism that provides a vacuum force for holding the first side of the media sheet to the first media transport, or an electrostatic force mechanism that provides an electrostatic force for holding the first side of the media sheet to the first media transport.

10. The media inverting system of claim 8 wherein the first media transport force mechanism is switchable between a first state and a second state, such that when the first media transport force mechanism is in the first state the first side of the media sheet is held to the first media transport, and when the first media transport force mechanism is in the second state the media sheet is not held to the first media transport, and wherein the control system also controls the first media transport force mechanism according to a control sequence including:

switching the first media transport force mechanism from the first state to the second state to transfer the media sheet to rotatable member when it arrives at the first transfer position;

wherein the control system switches the first media transport force mechanism to the second state in synchronization with switching the rotatable member force mechanism to the first state.

11. The media inverting system of claim 1 further including a second media transport force mechanism for holding the first side of the media sheet to the second media transport.

12. The media inverting system of claim 11 wherein the second media transport force mechanism is a vacuum force mechanism that provides a vacuum force for holding the first side of the media sheet to the second media transport, or an electrostatic force mechanism that provides an electrostatic force for holding the first side of the media sheet to the second media transport.

13. The media inverting system of claim 11 wherein the second media transport force mechanism is switchable between a first state and a second state, such that when the second media transport force mechanism is in the first state the first side of the media sheet is held to the second media transport, and when the second media transport force mechanism is in the second state the media sheet is not held to the second media transport, and wherein the control system also controls the second media transport force mechanism according to a control sequence including:

switching the second media transport force mechanism from the second state to the first state to transfer the media sheet to the second transport mechanism when it arrives at the second transfer position and to hold the first side of the media sheet to the second media transport as it is advanced along the second media transport path;

wherein the control system switches the second media transport force mechanism to the first state in synchronization with switching the rotatable member force mechanism to the second state.

14. The media inverting system of claim 1 wherein one or both of the first media transport and the second media transport are transport belt systems.

15. The media inverting system of claim 14 wherein each of the transport belt systems includes a transport belt travelling along a transport belt path around a plurality of rollers.

16. The media inverting system of claim 14 wherein at least one of the transport belt systems is a vacuum belt system.

17. The media inverting system of claim 1 further including one or more sensors to detect a position of the media sheet, wherein the control system switches the rotatable member force mechanism to the first state in response to detecting that the media sheet is at the first transfer position.

18. The media inverting system of claim 17 wherein the control system switches the rotatable member force mechanism to the second state in response to detecting that the media sheet is at the second transfer position.

19. The media inverting system of claim 1 wherein the first media transport advances the media sheet from an output of a printing module, and wherein the second media transport advances the media sheet to an input of the same printing module.

20. The media inverting system of claim 19, wherein the second media transport is a belt system including a belt travelling along a belt path around a plurality of rollers, and wherein the second media transport is adapted to advance the media sheet around at least one of said plurality of rollers, thereby reversing a direction of travel of the media sheet.

21. A media inverting system for a cut sheet printing system, comprising:

a first media transport for advancing a media sheet along a first media transport path in a first direction, the media sheet having a first side that contacts the first media transport and an opposing second side;

a rotatable member adapted to receive the media sheet from the first media transport at a first transfer position and rotate to advance the media sheet around the rotatable member to a second transfer position, the rotatable member having a rotation axis that is substantially parallel to the first direction, wherein the second transfer position is on an opposite side of the rotatable member from the first transfer position;

a rotatable member force mechanism switchable between a first state and a second state, wherein when the rotatable member force mechanism is in the first state the second side of the media sheet is held to the rotatable member, and when the rotatable member force mechanism is in the second state the media sheet is released from being held to the rotatable member; and a second media transport for receiving the media sheet from the rotatable member at the second transfer position and advancing the media sheet along a second media transport path in a second direction that is substantially parallel to the first direction, the rotatable member being positioned between the first media transport and the second media transport;

wherein the first side of the transferred media sheet contacts the second media transport, and wherein an orientation of the first and second sides of the media sheet is inverted while the media sheet is advanced along the second transport path relative to an orientation of the first and second sides of the media sheet while the media sheet is advanced along the first transport path;

wherein the rotatable member is a belt system including:

a first belt travelling around a first plurality of rollers; and a second belt travelling around a different second plurality of rollers;

wherein the first and second belts are adapted to invert first and second media sheets, respectively, that are advanced adjacent to one another by the first media transport.

* * * * *